US008950304B2

(12) United States Patent
Darby et al.

(10) Patent No.: US 8,950,304 B2
(45) Date of Patent: Feb. 10, 2015

(54) TAPE CUTTER

(75) Inventors: H. Darrel Darby, Huntington, WV (US); Wu Zhang, Proctorville, OH (US)

(73) Assignee: Darco International, Inc., Huntington, WV (US)

( * ) Notice: Subject to any disclaimer, the term of this patent is extended or adjusted under 35 U.S.C. 154(b) by 112 days.

(21) Appl. No.: 13/342,562

(22) Filed: Jan. 3, 2012

(65) Prior Publication Data

US 2012/0167731 A1 Jul. 5, 2012

Related U.S. Application Data

(60) Provisional application No. 61/429,312, filed on Jan. 3, 2011.

(51) Int. Cl.
*B26D 7/01* (2006.01)
*B26D 1/03* (2006.01)
*B26D 1/45* (2006.01)

(52) U.S. Cl.
CPC ..... *B26D 1/035* (2013.01); *B26D 1/455* (2013.01)
USPC ..... 83/56; 83/440

(58) Field of Classification Search
CPC ..... B26D 1/455; B26D 1/035; B26D 3/06; B26D 1/02; B26D 1/01; B26D 7/01; B26D 7/04; B26D 9/00; B26D 1/245; B26D 1/04; B26D 7/00; B29D 29/06; B65G 2201/02; B23D 19/06; B23D 33/02; B26B 5/00
USPC ..... 83/56, 440, 856, 858, 30, 425.4, 500; 30/304, 294, 858, 345, 363, 280; 428/422, 220; 225/7
See application file for complete search history.

(56) References Cited

U.S. PATENT DOCUMENTS

| | | | | | |
|---|---|---|---|---|---|
| 693,660 | A | * | 2/1902 | Lamont | 30/263 |
| 833,480 | A | * | 10/1906 | Nutter | 30/289 |
| 2,247,750 | A | * | 7/1941 | Dohnal | 225/94 |
| 2,428,490 | A | * | 10/1947 | Goughnour | 30/131 |
| 2,710,060 | A | * | 6/1955 | Birkmann | 83/649 |
| 2,788,852 | A | * | 4/1957 | Sharpe | 225/7 |
| 2,822,046 | A | * | 2/1958 | Krueger | 83/425 |
| 3,073,029 | A | * | 1/1963 | Beghetto, Jr. | 30/361 |
| 3,724,071 | A | * | 4/1973 | Hurtubise | 30/287 |
| 4,094,217 | A | * | 6/1978 | Exline | 83/879 |
| 4,342,349 | A | * | 8/1982 | Lipman | 144/371 |
| 4,385,440 | A | * | 5/1983 | Webb | 30/294 |
| 4,878,408 | A | * | 11/1989 | Isaacson et al. | 83/444 |
| 5,036,590 | A | * | 8/1991 | Reinke et al. | 30/304 |
| 5,894,978 | A | * | 4/1999 | Welch et al. | 225/7 |

* cited by examiner

*Primary Examiner* — Ghassem Alie
(74) *Attorney, Agent, or Firm* — Sughrue Mion, PLLC

(57) ABSTRACT

A tape cutting device includes a main body having a slot for guiding the tape therethrough. At least one finger is hingedly connected to the main body adjacent the slot, and a blade attached to the finger at a surface closest to the slot. A method of cutting a strip of tape includes moving the strip of tape through a main body along a path, and selectively pressing one or more fingers which each support a blade to move the blade into the path.

14 Claims, 3 Drawing Sheets

TAPE CUTTER

BACKGROUND OF THE INVENTION

1. Field of the Invention

The present invention relates to a device for cutting tape, and in particular for cutting therapeutic tape used for treating injured athletes.

2. Description of Related Art

Kinesiology tape is a form of therapeutic tape for treating athletic injuries as well as in various forms of rehabilitation. The taping method was first developed in the 1970's in Japan and has since surged in popularity since the 2008 Beijing Olympics, which saw the tape used by many high-profile athletes.

The tape is an elastic, cotton strip that generally includes an acrylic adhesive. One main difference between kinesiologic taping and the standard taping procedures is that rather than being applied to bind a joint or close a wound, the kinesiologic tape is applied in such a way as to lift the top layers of the skin, creating more space between the dermis and the muscle. This in turn, alleviates pressure on the lymphatic nodes, allowing better lymph drain-out throughout the applied area. The lifting effect also enables a user to relax muscles that have been overused and also decreases the risk of inflammation and pain in injured muscles. If used for rehabilitation, the opposite direction is taped and stretched.

Kinesiologic taping methods often employ a "fan" type structure in which the band of tape is cut into two or four identical strips which conjoin to a "base." It is paramount that these strips are identical in width. Oftentimes, however, time limits on application, e.g., during a sporting event or shortly after the injury, compounded with difficulty in cutting elastic material makes cutting symmetric, even strips in a short period of time quite difficult.

Accordingly, there remains a need for a device or method which allows a user to quickly and safely cut the tape into even symmetric strips, the number of which is determined by user preference.

SUMMARY OF THE INVENTION

An aspect of an exemplary embodiment provides a tape cutting device for cutting tape into longitudinal strips, the device includes a main body having a slot for receiving the tape therethrough; at least one finger extending from one wall of the main body; and a blade attached to the finger, wherein the blade is movable to a cutting position configured to cut the tape.

The device may include three fingers. The device may include an interconnecting member connecting two of the fingers. One of the fingers may be disposed between the two fingers that are interconnected, and the interconnecting member may extend over a portion of the one finger between the two interconnected fingers on a side of the one finger away from the slot. The main body may include a bottom wall, a top wall opposing the bottom wall, and a pair of side walls extending between the top wall and the bottom wall. An upstream end of the side walls may extend on an angle relative to a path of the main body along which the tape travels. The main body may include a depression aligned with the blade and which receives the blade when the blade is depressed. The finger may include a finger groove for receiving a finger of a user.

An aspect of another exemplary embodiment of the invention may provide a method of cutting a strip of tape, the method including:

moving the strip of tape through a main body along a path; and selectively pressing one or more fingers which each support a blade to move the blade into the path.

The number of the fingers may be three, and wherein if the selectively pressing includes pressing on one of an outer one among the fingers, all of the blades supported by the fingers may be moved into the path. If the selectively pressing comprises pressing on a middle one among the fingers, only the fingered by the middle finger may be moved into the path.

The exemplary embodiments allow a user to easily cut the tape into either two or four equally spaced pieces in a width direction of the tape depending on the preference of the user. Additionally, the user may safely and quickly cut the tape.

BRIEF DESCRIPTION OF THE FIGURES

The following drawings further describe by illustration the advantages and objectives of the present invention.

DETAILED DESCRIPTION OF THE EXEMPLARY EMBODIMENTS OF THE INVENTION

Figure 1:
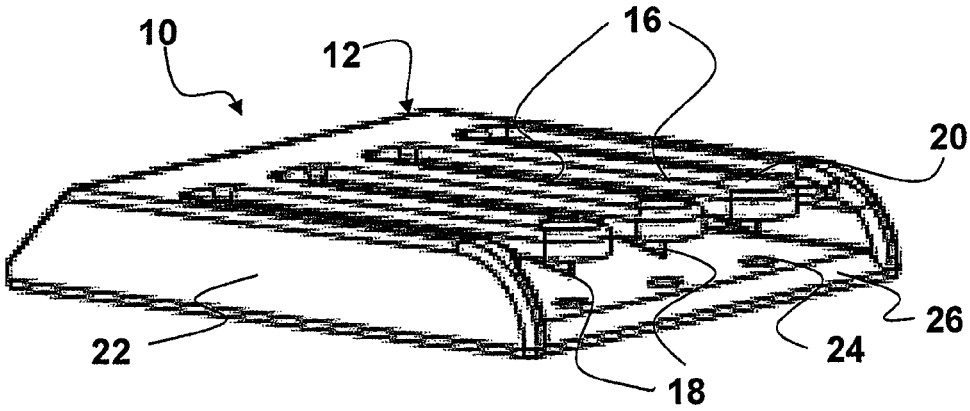
FIG. 1 is a front perspective view of an exemplary embodiment of the tape cutter.
Figure 2:
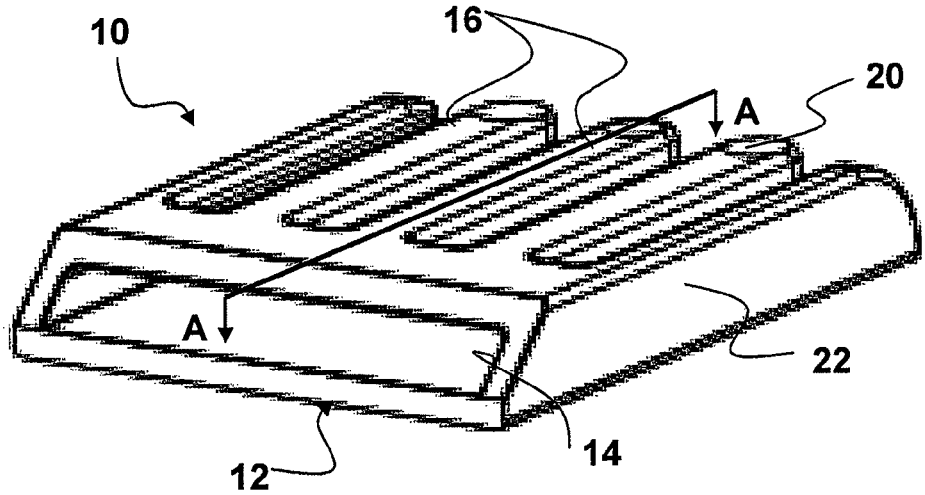
FIG. 2 is a rear perspective view of the exemplary embodiment of FIG. 1.

Throughout the detailed description like reference numerals correspond to like elements, and repetitive description of such elements is excluded.

Figure 3:
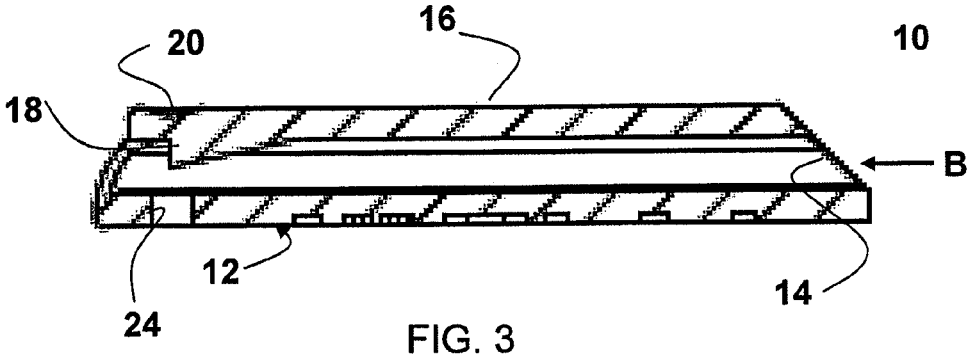
FIG. 3 is a side cross-sectional view of the exemplary embodiment of FIG. 2 taken along line A-A of FIG. 2.
Figure 5:
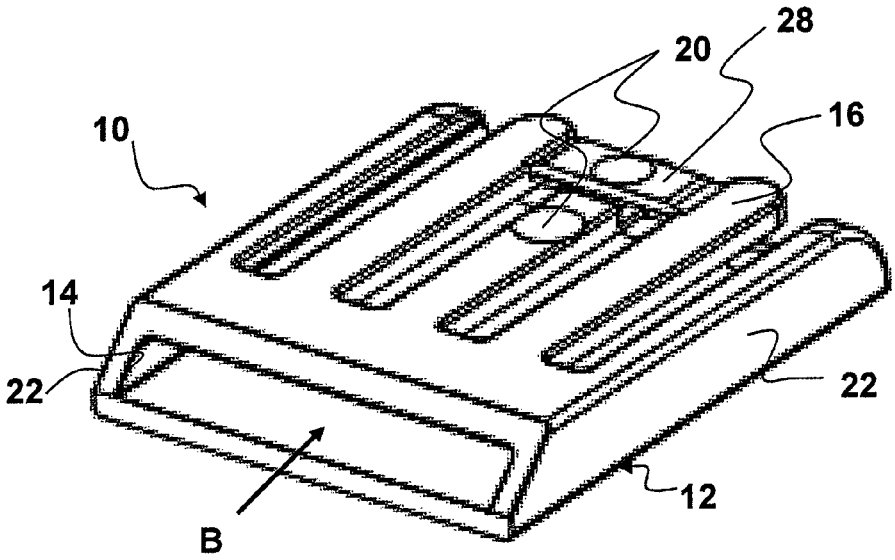
FIG. 5 is a rear perspective view of the exemplary embodiment of FIG. 3.

The tape cutter device 10 includes a box-shaped main body 12 having a slot 14 provided therein through which a tape (not shown) is received in the direction of arrow B of FIGS. 3 and 5. The box-shaped main body 12 includes a bottom wall, a top wall facing the bottom wall, and a pair of side walls interconnecting the top and bottom walls, and may be formed integrally as a single body. The top wall has a plurality of fingers 16 extending in a cantilevered manner therefrom parallel to direction B alongside the slot 14. In the exemplary embodiments, three fingers 16 extend from the main body 12.

Each finger 16 has a base end attached hingedly to the main body 12, and a distal end. The fingers 16 are preferably equally spaced from one another, but equal spacing is not necessary provided the fingers 16 are separated from one another to allow each finger 16 to move independently.

In the exemplary embodiments, the hinged attachment between the finger 16 and the body 12 is achieved by forming the material at the base end of the finger 16 of an elastically deformable material, wherein the finger 16 moves downwardly when the user presses on a top surface thereof.

Each finger 16 has a cutting blade 18 at a bottom surface of the distal end of the finger 16 for cutting the tape longitudinally, and a finger depression 20 at a top surface of the distal end of the finger 16 for receiving a user's finger. The cutting blade 18 may be any blade which is sufficiently sharp to cut through the tape. The finger depression 20 may be an indent or a through hole at the distal end of the finger 16.

Figure 4:
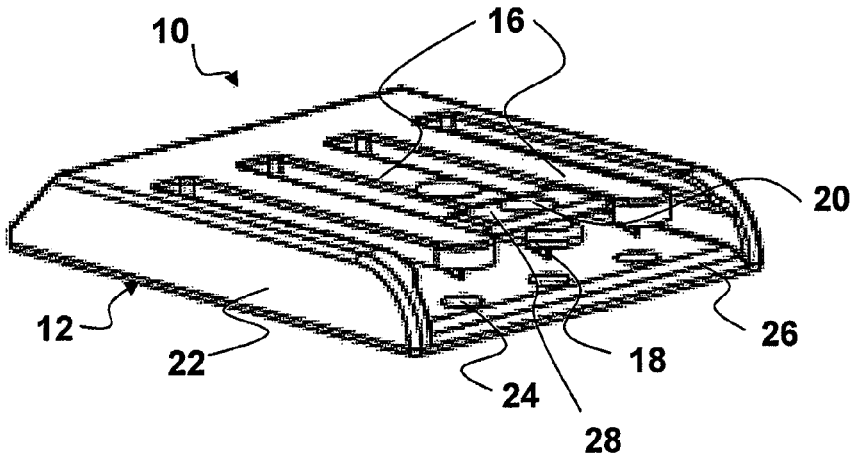
FIG. 4 is a front perspective view of another exemplary embodiment of the tape cutter.

In the exemplary embodiment of FIGS. 4 and 5, two of the three fingers 16 are attached to one another through an interconnecting member 28. The interconnecting member 28 extends over a portion of a middle one of the fingers 16, i.e., at a side facing away from the path through which the tape travels, to interconnect a pair of fingers 16 disposed on each side of the middle finger 16.

The bottom wall of the main body 12 includes a plurality of blade depression 24, or through holes, near a rear (downstream) edge of the bottom wall below each blade 18 to receive each respective blade 18. The rear edge of the bottom wall of the main body 12 is opposite to the forward edge at which the slot 14 is disposed, and is formed with a chamfer 26.

In operation, a user selectively presses on one or more of the fingers 16 while pulling tape through the slot 14 in the direction B. By this arrangement, the tape will be cut only by the blades 18 disposed on the fingers 16 against which the user presses. For example, the user may press on only the middle one of the three fingers 16 of FIG. 1, and the tape will be cut into two longitudinal strips having equal widths. If the user presses on all three fingers 16, the tape will be cut into four longitudinal strips having equal widths.

In the exemplary embodiment of FIGS. 4 and 5, which includes the interconnecting member 28, when the user presses on only the middle finger 16, the tape will be cut into two longitudinal strips having equal width. On the other hand, when the user presses on the interconnecting member 28 or on either of the fingers 16 that are interconnected through the interconnecting member 28, the fingers 16 that are interconnected, as well as the finger 16 thereinbetween, are all pressed down to divide the tape into four longitudinal strips of equal width. As such, the user can divide the tape longitudinally into four equal strips without having to press on multiple fingers 16.

While the foregoing has described the general physical aspects of the invention and is to serve as an aide to better understanding the intended use and application of the invention, one skilled in the art would understand that the present invention is not limited to the detailed construction, fabrication, material or application of use described and illustrated herein. Other variations of fabrication, use or application are within the scope of the invention as alternative embodiments.

What is claimed is:

1. A tape cutting device for cutting a strip of tape, the device comprising:

a main body having a slot for receiving the tape therethrough;

the main body having a bottom wall, a top wall facing the bottom wall, and a pair of side walls, the pair of side walls being connected by the top wall and the bottom wall to form the slot, a plurality of fingers extending directly from the top wall of the main body in a cantilevered manner; and a blade being attached to a bottom surface of each finger and a top surface of each finger being flat, wherein each finger has a capability of being independently movable to a cutting position, wherein the plurality of fingers being configured to cut the tape in symmetric sections, and the plurality of fingers are elastically deformable and integrated with the top wall, wherein the top surface of each finger is in plane with a top surface of the top wall in a non-pressed position, and the top surface of each finger is lower than a top surface of the top wall in a pressed-position.

2. The tape device according to claim 1, wherein the plurality of fingers includes at least three fingers.

3. The tape device according to claim 2, further comprising an interconnecting member connecting two of the fingers.

4. The tape device according to claim 3, wherein one of the fingers is disposed between the two fingers that are interconnected, and the interconnecting member extends over a portion of the one finger between the two interconnected fingers on a side of the one finger away from the slot.

5. The tape device according to claim 1, wherein an upstream end of the pair of side walls extend on an angle relative to a path of the main body along which the tape travels.

6. The tape device according to claim 1, wherein the main body comprises a depression aligned with the blades and which receives the blades when the blades are depressed.

7. The tape device according to claim 1, wherein each finger includes a finger groove for receiving a finger of a user.

8. A method of cutting a strip of tape using the tape cutting device of claim 1, moving the strip of tape through the main body along a path; and selectively pressing at least one of the fingers.

9. The method according to claim 8, wherein if the selectively pressing comprises pressing on one of an outer one among the fingers, all of the blades supported by the fingers are moved into the path.

10. The method according to claim 9, wherein if the selectively pressing comprises pressing on a middle one among the fingers, only the blade attached to the middle finger is moved into the path.

11. The device of claim 1, wherein the plurality of fingers are of an elastically deformable material.

12. The device of claim 1, wherein the plurality of fingers move the blade to a cutting position configured to cut the tape.

13. The device of claim 1, wherein the plurality of fingers are spaced from each other.

14. The device of claim 1, wherein the slot for receiving the tape therethrough is defined between an integrated bottom surface of the top wall and the plurality of fingers and a top surface of the bottom wall.

* * * * *